US005733656A

United States Patent [19]

Iohara et al.

[11] Patent Number: 5,733,656

[45] Date of Patent: Mar. 31, 1998

[54] POLYESTER FILAMENT YARN AND PROCESS FOR PRODUCING SAME, AND FABRIC THEREOF AND PROCESS FOR PRODUCING SAME

[75] Inventors: Koichi Iohara; Mie Yoshimura; Shinji Owaki; Toshimasa Kuroda, all of Ibaraki, Japan

[73] Assignee: Teijin Limited, Osaka, Japan

[21] Appl. No.: 727,432

[22] PCT Filed: Feb. 28, 1996

[86] PCT No.: PCT/JP96/00466

§ 371 Date: Oct. 11, 1996

§ 102(e) Date: Oct. 11, 1996

[87] PCT Pub. No.: WO96/27036

PCT Pub. Date: Sep. 6, 1996

[30] Foreign Application Priority Data

Feb. 28, 1995 [JP] Japan ..... 7/39779
Mar. 1, 1995 [JP] Japan ..... 7/41866

[51] Int. Cl.[6] ..... D02G 3/00

[52] U.S. Cl. ..... 428/397; 428/373; 428/375; 428/395

[58] Field of Search ..... 428/395, 370, 428/374, 373, 397, 325; 264/171

[56] References Cited

U.S. PATENT DOCUMENTS 4,245,001 1/1981 Phillips et al. ..... 428/224
4,364,998 12/1982 Wei ..... 428/399
4,381,333 4/1983 Okumoto ..... 428/373
5,059,482 10/1991 Kawamoto et al. ..... 428/397

FOREIGN PATENT DOCUMENTS 652948 5/1951 United Kingdom .

*Primary Examiner*—Newton Edwards
*Attorney, Agent, or Firm*—Finnegan, Henderson, Farabow, Garrett & Dunner

[57] ABSTRACT

A polyester filament yarn made by treating a polyester filament with an aqueous alkali solution, which filament is composed of a core extending over the length of filament and a plurality of fins bonded to the core over the length of the core and radially extending from the core, and which satisfies the following three requirements:

(1) $1/20 \leqq SB/SA \leqq 1/3$, (2) $0.6 \leqq LB/DA \leqq 3.0$, and (3) $WB/DA \leqq 1/4$ wherein SA and DA are cross-sectional area and diameter of the core, and SB, LB and WB are cross-sectional area, maximum length and maximum width of the fins, respectively. The fins are at least partially separated from the core by the alkali treatment. A fabric composed of the filament yarn has soft touch and feeling, high bulkiness and uniform appearance.

11 Claims, 3 Drawing Sheets

POLYESTER FILAMENT YARN AND PROCESS FOR PRODUCING SAME, AND FABRIC THEREOF AND PROCESS FOR PRODUCING SAME

TECHNICAL FIELD

This invention relates to a specific polyester filament yarn, a process for producing the filament yarn, a fabric of the filament yarn, and a process for producing the fabric. More specifically, it relates to a polyester filament yarn made by treating a polyester filament composed of a core and fins bonded to the core, with an alkali, whereby the fins are separated from the core and large vacant spaces are formed within the filament yarn; a process for producing the filament yarn; a fabric comprised of the filament yarn and having a soft touch and feeling and high bulkiness; and a process for producing the fabric.

BACKGROUND ART

Polyester fibers, especially, polyethylene terephthalate multifilaments are widely used as a material for clothing. However, polyester multifilaments have a dense fiber structure and thus have a rather stiff touch and a poor bulkiness.

Attempts of enhancing the bulkiness and affording a soft touch have been proposed in Japanese Examined Patent Publication (JP-B) 1-12487 and JP-B 1-16922 that describe bulky filaments characterized by having a body portion and wing portions separated from the body portion, part of the wing portions being broken and having free protruding fiber ends; and further describe splitable filaments from which the bulky filaments can be made.

The splitable filaments are made by extruding a molten polymer through single orifices and therefore the body portion and the wing portions are integrated together, and thus, it is very difficult to separate the wing portions from the body portion. To separate and split the wing portions from the body portion, a physical means causing a large energy transfer, such as a fluid nozzle treatment utilizing a high-pressure compressed air, must be employed. Further, a predominant part of the wing portions thus-separated by such physical means are broken or fibrillated to form free protruding fiber ends, and therefore, the filaments have an appearance like a fluffy spun yarn. A fabric woven or knitted from the filament has a poor uniformity.

JP-B 2-38699 discloses a yarn having 10 to 150 free protruding fiber ends per centimeter, made of synthetic fibers composed of a substantially continuous body portion and wing portions split from the body portion, which have coarse edges and a part of which forms free protruding fiber ends. This yarn also has an appearance like a fluffy spun yarn, and, since the wing portions have coarse edges and fibrils, woven and knitted fabrics made therefrom are of poor uniformity.

A process for imparting a soft and silky touch to a woven or knitted fabric composed of polyester fibers is known (for example, it is described in British Patent 652,948) wherein the fabric is treated with an alkali whereby the weight is reduced and the pressing force applied between adjacent fibers is minimized. This alkali treatment enables only to reduce uniformly the diameter of the polyester fibers and consequently form small vacant spaces among the polyester fibers. Thus the bulkiness of the fabric is enhanced only to a limited extent by the alkali treatment.

DISCLOSURE OF INVENTION

A primary object of the present invention is to provide a polyester filament yarn made by treating a polyester filament composed of a core and fins bonded to the core, with an alkali, to separate the fins from the core and form large vacant spaces within the filament yarn; and a process by which the polyester filament yarn can be produced in an industrially advantageous manner.

Another object of the present invention is to provide a fabric comprised of the polyester filament yarn and having a soft touch and feeling, high bulkiness and uniform appearance.

To achieve the above-mentioned objects, the inventors conducted researches and had the following findings. Where a polyester filament composed of a core extending over the length of filament and a plurality of fins bonded to the core over the length of the core and radially extending from the core is made by a procedure wherein a molten polyester is extruded through a spinneret having a core-forming orifice and fin-forming orifices independent from the core-forming orifice and the molten extrudate from the core-forming orifice is contacted with and bonded to the molten extrudates from the fin-forming orifices so that the degree of orientation of the fins is enhanced as compared with that of the core and the configurations of the core and the fins are made specific, the thus-made polyester filament is advantageous in that the fins are capable of being easily separated from the core, and the filament affords a filament yarn having the above-mentioned preferred properties. It was further found that, where a compound capable of being microscopically phase-separated from the polyester is incorporated in the polyester, the separation of the fins from the core is more easily conducted. On the basis of these findings, the present invention has been completed.

In one aspect of the present invention, there is provided a polyester filament yarn which is made by treating a polyester filament with an aqueous alkali solution, said polyester filament being composed of a core extending over the length of filament and a plurality of fins bonded to the core over the length of the core and radially extending from the core, and said polyester filament satisfying the following requirements (1), (2) and (3):

(1) $1/20 \leqq SB/SA \leqq 1/3$ (2) $0.6 \leqq LB/DA \leqq 3.0$ (3) $WB/DA \leqq 1/4$ wherein SA represents cross-sectional area of the core, DA represents diameter of the core when the cross-sectional shape of the core is true circle, or diameter of the circumscribed circle of the core when the cross-sectional shape of the core is not true circle, and SB, LB and WB represent cross-sectional area, maximum length and maximum width of the fins, respectively; said fins being at least partially separated from the core by the treatment with the aqueous alkali solution.

In another aspect of the present invention, there is provided a process for producing a polyester filament yarn which comprises:

extruding a molten polyester through a spinneret having an orifice for forming a core and a plurality of slit-form orifices for forming fins which are arranged at intervals around the core-forming orifice in a configuration of radially extending from the core-forming orifice so that a molten polyester extrudate from the core-forming orifice is contacted with molten polyester extrudates from the fin-forming orifices;

cooling the contacted molten polyester extrudates whereby a solidified filament is formed which is composed of a core extending over the length of filament and a plurality of fins bonded to the core over the length of the core and radially extending from the core, and which satisfies the above requirements (1), (2) and (3); and thereafter treating the filament with an aqueous alkali solution to reduce the weight of the filament and at least partially separate the fins form the core.

In still another aspect of the present invention, there is provided a fabric comprising the above-mentioned polyester filament yarn.

In a further aspect of the present invention, there is provided a process for producing a polyester fabric characterized by the steps of:

bringing a molten polyester extrudate through a core-forming central orifice into contact with molten polyester extrudates through a plurality of fin-forming slit-form orifices which are arranged at intervals around the core-forming central orifice in a configuration of radially extending from the coreforming orifice, whereby the extrudate from the core-forming orifice is bonded to the extrudates from the fin-forming orifices;

cooling the joined molten extrudates to solidify the extrudates to form a filament composed of a core extending over the length of filament and a plurality of fins bonded to the core over the length of the core and radially extending from the core, said filament satisfying the above-mentioned three requirements (1), (2) and (3);

weaving or knitting a multifilament yarn comprising the thus-formed filaments into a fabric; and then treating the fabric with an aqueous alkali solution to reduce the weight of the fabric.

BEST MODE FOR CARRYING OUT THE INVENTION

Figure 1:
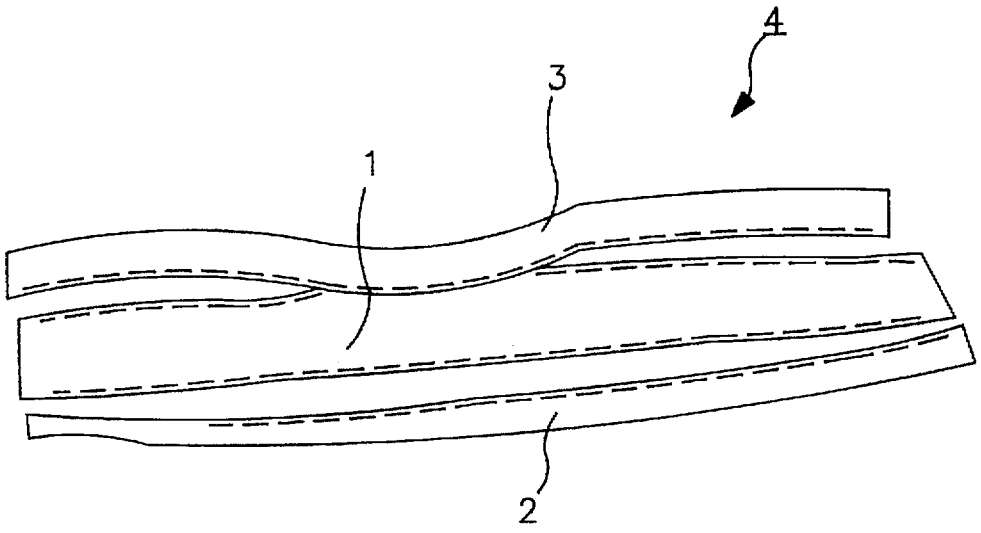
FIG. 1 is an enlarged side view showing an example of the polyester filament yarn of the present invention, wherein a polyester filament yarn 4 is composed of core 1 and fins 2 and 3, predominant parts of which are separated form core 1.

In reference to FIG. 1, the polyester filament yarn 4 is composed of a core I extending over the length of filament, and a plurality of fins 2, 3. Before the alkali treatment, the fins including fins 2 and 3 are bonded to the core 1 over the length of the core and radially extend from the core 1. However, when the polyester filament yarn is treated with an alkali, the fins are separated from the core 1 and become independent filaments as illustrated in FIG. 1.

It is preferable that the fins are completely separated from the core over the entire length thereof and behave independently from the core, as illustrated as fin 2 in FIG. 1. But, the fins may not necessarily be completely separated over the entire length thereof and may be partially bonded to the core, as illustrated as fin 3 in FIG. 1. To obtain a woven or knitted fabric having a good bulkiness, the degree of separation S of fins, as hereinafter defined, is preferably at least 30%.

As the fins are separated from the core 1, in the case where the filament yarn is, for example, in the form of a woven or knitted fabrioc, a large vacant space is formed between the adjascent cores within the woven or knitted fabric, and therefore, the woven or knitted fabric is of an enhanced bulkiness (in FIG. 1, the filament is composed of one core and four fins, but only two fins 2 and 3 are illustrated in FIG. 1).

Figure 2B:
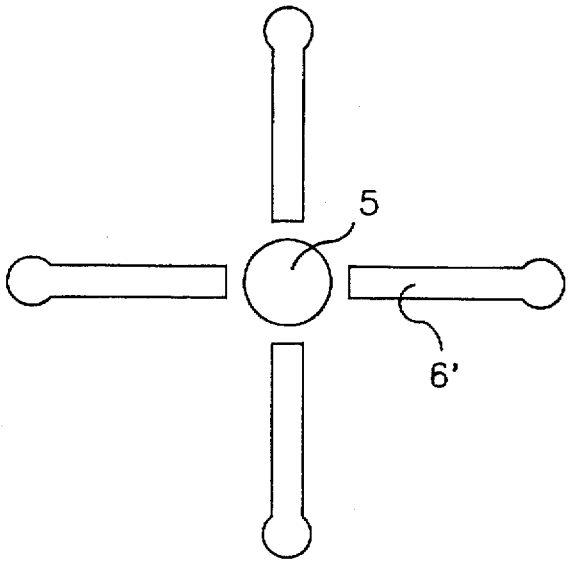
FIG. 2B is an enlarged plan view showing a modification of the orifices of a spinneret shown in FIG. 2A.
Figure 3:
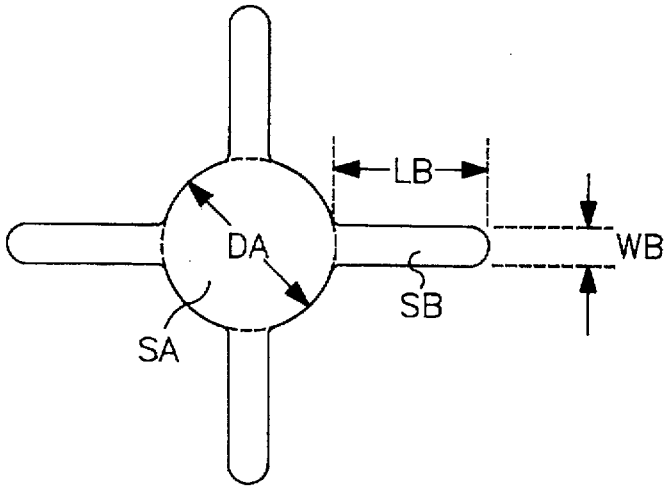
FIG. 3 is an enlarged sectional view showing the polyester filament yarn produced by using the spinneret with orifices shown in FIG. 2B.

As hereinafter explained, the filament having a cross-section shown in FIG. 3 is obtained by extruding a polymer through a spinneret having orifices 5, 6' shown in FIG. 2B. The fin-forming slit-form orifices 6' have a cross-section smaller than that of the core-forming circular orifice 5. The fins exhibit a higher degree of orientation than the core. Therefore, the fins shrink only to a lesser extent than the core when the filament is heated at the step of the alkali treatment and the step of dyeing or finishing the woven or knitted fabric. Thus the difference in shrinkage between the core and the fins becomes prominent, and loops and difference in fiber lengths are formed with the result of enhancement in bulkiness.

It is preferable that the fins separated from the core are not broken and form free protruding fiber ends only to a minimum extent. Namely, very limited number of free protruding fiber ends may be present in the woven or knitted fabric, which are incidentally formed in the step of filament formation or weaving or knitting. But, it must be avoided in the invention to purposely form fluffs, i.e., free protruding fiber ends by employing a physical means such as a high-pressure air blowing nozzle as described in, for example, JP-A 1-12487.

The process for producing the polyester filament yarn of the present invention will now be described in detail.

The polyester used for the manufacture of the filament yarn of the present invention is preferably a polyester comprising at least 85% by mole, more preferably at least 90% by mole of ethylene terephthalate units based on the entire repeating units. The polyester used may be composed of either a single polyester or a blend of at least two polyesters. However, a composite filament yarn composed of two or more kinds of polyester parts is excluded from the filament yarn of the present invention.

The viscosity of the polyester used is not particularly limited, and may be similar to those which are conventionally used for melt-spinning and have an intrinsic viscosity of 0.5 to 1.1.

Provided that the object of the present invention is achieved, a small amount of additives such as delustrants and inorganic auxiliaries can be incorporated in the polyester.

A preferable additive is a compound having a compatibility parameter $\chi$ of 0.1 to 2.0, which parameter is defined by the following equation:

$$\text{Compatibility parameter } \chi=(Va/RT)(\delta a-\delta b)^2$$

wherein Va is molar volume ($cm^3$/mol) of polyester, R is gas constant (J/mol K), T is absolute temperature (°K), and $\delta a$ and $\delta b$ represent solubility parameters ($J^{1/2}/cm^{3/2}$) of the polyester and the compound, respectively. Where this compound is incorporated in the polyester in an amount of 0.5 to 5.0% by weight based on the total weight of the polyester composition, the effect of the present invention can be more enhanced.

A compound having a compatibility parameter $\chi$ smaller than 0.1 exhibits an excessively high solubility with the polyester, and therefore, where it is incorporated in the polyester, the separation of the fins by an alkali treatment becomes difficult. Where a compound having a compatibility parameter $\chi$ larger than 2.0 is incorporated in the polyester, the compound and the polyester are separated from each other and the viscosity of the mixture undesirably increases with the results of reduction of melt-spinnability.

Where the amount of the above-mentioned compound is smaller than 0.5% by weight, the effect of the present invention is enhanced only to a lesser extent. In contrast, where the amount of said compound is larger than 5.0% by weight, the compound tend to agglomerate and thus the effect of the present invention cannot be enhanced.

As specific examples of the above-mentioned compound, there can be mentioned polymeric materials such as polyethylene, polypropylene, polyisobutylene, polystyrene, polytetrafluoroethylene, polytetrachloroethylene, polychlorotrifluoroethylene, polyvinyl propionate, polyheptafluorobutyl acrylate, polybutadiene, polyisoprene, polychloroprene, polyethylene glycol, polytetramethylene glycol, polytriethylene glycol, polymethyl acrylate, polypropyl acrylate, polybutyl acrylate, polyisobutyl acrylate, polymethyl methacrylate, polyethyl methacryalte, polybenzyl methacrylate, polyethoxyethyl methacrylate, poly formaldehyde, polyethylene sulfide and polystyrene sulfide; silicone; and modified products thereof. These compounds may be used either alone or in combination.

The above-mentioned compound preferably has an average molecular weight of 3,000 to 25,000. If the average molecular weight is too low, the polyester tends to be thermally degraded in an extruder or a spinning pack. If the average molecular weight is too high, the melt-compatibility of the compound with the polyester is reduced.

The above-mentioned compound can be incorporated in the polyester by the conventional procedures. For example, there are adopted a process wherein the compound and the polyester are kneaded together and melted, and then the molten mixture is pelletized; a process wherein the compound is incorporated in the polyester by an injection blending procedure; and a process wherein the polyester and the compound are mixed together by a static mixer.

Figure 2A:
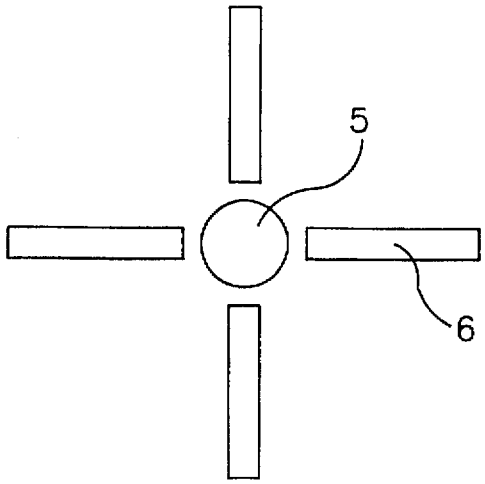
FIG. 2A is an enlarged plan view showing an example of orifices of a spinneret used for producing the polyester filament yarn of the present invention.

The molten polyester is extruded, for example, through a spinneret having a circular orifice 5 for forming a core and a plurality of slit-form orifices 6 for forming fins (the number of slit-form orifices in FIG. 2A is 4) which are radially arranged at intervals around the circular orifice 6, as illustrated in FIG. 2A.

The molten polyester extrudates are contacted with each other whereby the extrudates are bonded, and then cooled to be thereby solidified. Thus a polyester filament is formed which has (i) a core having a circular cross-section and extending over the length of filament and (ii) a plurality of fins bonded to the core over the length of the core and radially extending from the core. If desired, the filament is subjected to a drawing and/or a heat-treatment.

Where the number of fin-forming slit-form orifices in a spinneret is 1 or at least 7, the vacant space formed in the filament yarn by the weight-reducing alkali treatment is small, and the bulkiness of the filament yarn becomes poor. It is preferable that 3 to 6 fin-forming slit-form orifices are arranged around one core-forming orifice. The most preferable number of fin-forming slit-form orifices is 4.

The fin-forming slit-form orifices may have different cross-sectional areas, maximum lengths and maximum widths. It is preferable that the radially extending fin-forming slit-form orifices are equally arranged around the core-forming orifice, but a modified arrangement can be adopted.

The dimensions of the core-forming circular orifice 5 and the fin-forming slit-form orifices 6 are not particularly limited. But, in order to produce the filament yarn of the present invention having a core with a cross-sectional area AS and a diameter DA, and fins with a cross-sectional area SB, a maximum length LB and a maximum width WB, which satisfy the above-mentioned three requirements (1), (2) and (3), it is preferable that the following three requirements (i), (ii) and (iii) are satisfied.

(i) $1 \leqq L'B/D'A \leqq 4$ (ii) $1/7 \leqq W'B/D'A \leqq 1/2$ (iii) $0.01\ \text{mm} \leqq L'AB \leqq 0.2\ \text{mm}$ wherein D'A represents a diameter of the core-forming circular orifice 5 when the orifice shape is true circle, or a diameter of the circumscribed circle of the core-forming circular orifice 5 when the orifice shape is not true circle; L'B and W'B represent maximum length and maximum width of the fin-forming slit-form orifices 6, respectively; and L'AB represents the shortest distance between the core-forming orifice 5 and the fin-forming orifices 6.

Where D'A, L'B, W'B and L'AB do not satisfy the above-requirements (i), (ii) and (iii), the melt-spinnability is apt to be deteriorated and the spinneret tends to be easily abraded.

The fin-forming slit-form orifices may be either of uniform rectangular form 6 as illustrated in FIG. 2A, or of a modified rectangular form such as a rectangular form 6' having a round end portion, as illustrated in FIG. 2B, or a strip form having a continuously varied width.

If the polyester is extruded through a spinneret having single orifices each capable of forming a filament composed of a core and fins bonded to the core, the core and the fins have approximately the same degree of orientation, and the separation of the fins from the core by an alkali treatment becomes difficult.

The filament yarn produced by the above-mentioned process satisfies the following three requirements (1), (2) and (3):

(1) $1/20 \leqq SB/SA \leqq 1/3$ (2) $0.6 \leqq LB/DA \leqq 3.0$ (3) $WB/DA \leqq 1/4$ wherein SA represents a cross-sectional area of the core, DA represents a diameter of the core when the cross-sectional shape of the core is true circle, or a diameter of the circumscribed circle of the core when the cross-sectional shape of the core is not true circle, and SB, LB and WB represent cross-sectional area, maximum length and maximum width of the fins, respectively, as illustrated in FIG. 3.

If SB/SA (the ratio of cross-sectional area of fins to cross-sectional area of core) is smaller than 1/20 or larger than 1/3, the filament yarn has a poor bulkiness.

If LB/DA (the ratio of maximum length of fins to diameter of core) is smaller than 0.6, the filament yarn has a poor bulkiness. In contrast, if LB/DA is larger than 3.0, the fins are bent and the touch becomes stiff.

If WB/DA (the ratio of maximum width of fins to diameter of core) is smaller than 1/4, the separation of fins by an alkali treatment becomes difficult. The smaller the maximum width of fins WB, the easier the separation of the fins by an alkali treatment. However, if WB/DA is too small, the fins are bent. Therefore, WB/DA is preferably at least about ⅛.

More specifically, the fins preferably have a thickness not larger than 0.8 denier, more preferably not larger than 0.6 denier. If the thickness of the fins is too large, the alkali-treated fabric does not have the intended soft touch nor have good draping property.

The core preferably has a thickness of 1 to 4 deniers. If the thickness of the core is larger than 4 deniers, even when the core and the fins are completely separated, the fabric does not have the intended soft touch and the feeling is stiff. In contrast, if the thickness of the core is smaller than 1 denier, even if the filament has a multi-lobal cross-section with a sharp shape, a bundle of the filaments becomes highly compact and the vacant space among the filaments is too small.

At the step of melt-spinning the polyester, the polymer extruded through the fin-forming slit-form orifices is drawn at a higher draft ratio than the polyester extruded through the core-forming circular orifice. Therefore the fins exhibit a higher degree of orientation that that of the core. The filament is characterized in that the molecular entanglement occurring at the interface between the core and the fins is minimized, and thus, the bonding force between the core and the fins is low and, when the filament is subjected to an alkali treatment, the fins can easily be separated from the core and the difference in shrinkage between the fins and the core is clearly manifested with the result of a soft touch and a high bulkiness.

The separation of the fins from the core by an alkali treatment is further advantageous in that the formation of free protruding fiber ends is minimized and thus the treated fabric has a uniform appearance. This is in sharp contrast to the conventional bulky fabrics produced from filaments to which bulkiness has been imparted by a physical means causing a large energy transfer, such as a fluid blow treatment comprising blowing a compressed air against the flament, and which have inevitably formed free protruding fiber ends and fibrillated fins. The conventional bulky fabrics have a spun yarn-like appearance and a poor uniformity.

The alkali treatment for the separation of the fins from the core is conducted on any of the polyester filament, a yarn thereof, and woven or knitted fabric made thereof. Preferably, the alkali treatment is conducted on a woven or knitted fabric, which is made of a multifilament yarn of polyester filaments alone or a combination thereof with other polyester filaments.

As the procedure for the alkali treatment, a procedure similar to those employed for the treatment of the conventional polyester filaments can be employed. More specifically the alkali treatment is conducted usually by using an aqueous solution containing 10 to 100 g/l of an alkali such as sodium hydroxide, potassium hydroxide, sodium carbonate or potassium carbonate, at a temperature of 40° to 180° C. for a period of 2 minutes to 2 hours.

The procedure for making the polyester multifilament yarn from a combination of the polyester filament of the invention with other polyester filament is not particularly limited, and the conventional procedures can be employed which include, for example, doubling, twisting and air-blowing entangle treatment.

It is especially preferable that at least 30% by weight of the above-mentioned polyester filament (hereinafter referred to as "filament A") having the core and the fins is combined with not larger than 70% by weight of a filament (hereinafter referred to as "filament B") having a boiling water shrinkage at least 5% larger than that of filament A, and the combined filaments A and B are subjected to an air-blowing entangle treatment to make a commingled multifilament yarn for weaving or knitting, followed by weaving or knitting and an alkali treatment. The commingled multifilament yarn preferably comprises at least 30% by weight of filament A, and if the amount of filament A is smaller than 30%, the softness to touch of fabric and the draping property are poor.

Filament B to be commingled with filament A with a multilobal cross-section preferably has a boiling water shrinkage at least 5% larger than that of filament A. A fabric woven or knitted from a commingled filament yarn composed of filaments A and filaments B having a higher boiling water shrinkage is characterized in that, when the fabric is subjected to heat shrinkage, predominant part of the filaments A are located in the surface portion of the yarn and predominant part of the filaments b are located in the center portion of the yarn, and thus, the yarn exhibits good feeling and soft touch.

To give crimps to the commingled multifilament yarn composed of filaments A and B, and to impart a more enhanced bulkiness and an elegant feeling to the fabric, filament B preferably has a boiling water shrinkage of at least 10%. If the boiling water shrinkage of filament B is too small, the fabric has poor bulkiness and is not lightweight. However, if the boiling water shrinkage is too large, the feeling of the fabric becomes stiff, and therefore, the boiling water shrinkage is preferably not larger than 50%.

The boiling water shrinkage of filament A is preferably smaller than 10%. By combining filament B with filament A, when the resulting woven or knitted fabric is subjected to heat shrinkage, filament B occupies the central part of the commingled multifilament yarn, i.e., filament A forms a sheath surrounding filament B. When the fabric is treated with an aqueous alkali solution to separate the fins from the core in the sheath filament A, vacant spaces are formed predominantly in the surface portion of the commingled multifilament yarn, and the individual multifilament yarns within the fabric have a high freedom. The surface of the fabric is covered with fine filaments derived from the fins. Thus the soft touch and feeling of the fabric are more enhanced, and the fabric exhibits elegant draping properties.

Filament A with a multi-lobal cross-section used for the production of the commingled filament yarn preferably has a self-elongating property to much more enhance the draping property and bulkiness of the fabric. More specifically filament A preferably exhibits a dry heat shrinkage between −6% and 0% as measured at 160° C. Where the fabric is heat-set, filament A elongates and the fabric becomes more bulky and drapery. However, if filament A elongates by more than 6%, it is raised to an undesirably large extent on the surface of the fabric.

Preferably, filament B has a thickness of not larger than 8 deniers (single filament denier), more preferably in the range of 1 to 7 deniers. If the thickness of filament B is too large, the woven or knitted fabric has a stiff feeling. The cross-sectional shape of filament B is not particularly limited, and may be, for example, round, rectangular (i.e., the filament is flat belt-like), polygonal, hollow or multi-lobal (i.e., similar to that of filament A).

The above-mentioned commingled multifilament yarn is subjected to an alkali treatment whereby the multi-lobal filament A is divided into a plurality of filaments. The fabric composed of the thus-alkali-treated multifilament yarn has a very soft touch and much enhanced bulkiness. This is in a sharp contrast to a bulky fabric made from a conventional multifilament yarn composed of divided fine filaments. The conventional multifilament yarn is made by a process wherein a filament with a multi-lobal cross-section is subjected to a Taslan or air jet treatment in a drawing step wherein compressed air is blown against the filament at a pressure of 10 to 40 kg/cm$^2$ whereby division of the multi-lobal cross-section filament and fluff formation are effected to give a filament yarn with a soft touch and a spun yarn-like bulkiness. Where this conventional filament yarn is woven or knitted into a fabric, the divided fine filaments are inevitably densified in an after-treatment step such as twisting step, and thus, the vacant spaces within the fabric are not large. The fabric is not satisfactory in touch and bulkiness. Further, in view of the fluff on the surface, the fabric has poor handling characteristics and weaving and knitting properties.

The process for making the commingled multifilament yarn will now be described in more detail. Usually the following three processes can be employed.

In the first process, two filaments A and B are separately taken up and, either successively drawn, or once wound and thereafter drawn, at an appropriate ratio and then heat-set. Thereafter, filaments A and B are combined into a commingled multifilament yarn. Filaments A and B used may be a flat yarn (i.e., non-crimped yarn) or may be either a crimped yarn or a latently crimped yarn. The heat-setting of filaments A and B is preferably conducted under different conditions, for example, at different temperatures, so that filament B has a boiling water shrinkage at least 5% larger than that of filament A. The commingled filament yarn is made preferably by a procedure wherein filaments A and B are doubled to obtain a doubled yarn and the doubled yarn is subjected to a compressed air blowing entangle treatment by using an air jetting nozzle such as an interlacing nozzle, a false twisting nozzle or a Taslan nozzle. By the air stream impinging against the filaments, the individual filaments are disturbed, and the fins are buffeted with the result that the bonding of the fins to the core is weakened. Thus when the commingled filament yarn is treated with an aqueous alkali solution, the alkali readily diffuses and penetrates into the interface between the core and the fins, and the fins can easily be separated from the core. The pressure of the compressed air is preferably in the range of 0.5 to 2.5 kg/cm$^2$. If the pressure is too low, the intended enhancement of fin-separation effect cannot be attained. In contrast, if the pressure is too high, the weaving or knitting properties are deteriorated and the bulkiness of the fabric is reduced.

In the second process, as-spun undrawn filaments A and B are taken up and, either successively doubled or once wound and then doubled, and simultaneously drawn and heat-set, either consecutively from the spinning or after once wound. Before the drawing or after the heat-setting, the doubled yarn is subjected to a compressed air blowing entangle treatment. The melt spinning of the two filaments A and B can be carried out by using a single spinneret or separate spinnerets. Where separate spinnerets are used, it is preferable that filament B is melt-spun at a higher rate than that of filament A. Where a single spinneret is used, it is preferable that the spinning is effected under conditions such that or by using a spinneret designed so that filament B is drafted at a higher rate than that of filament A.

In the third process, a self-elongating property is imparted to filament A. More specifically, a polyester is melt-spun at a high rate of 2,000 to 4,000 m/min and the as-spun filament is taken up in a partly drawn state, and, either successively from the melt-spinning or after once wound, the filament is drawn at an appropriate ratio and then heat-treated under relaxed conditions whereby a self-elongating property is imparted to the filament. The self-elongating filament A is combined with filament B to afford a commingled multifilament yarn, as mentioned above.

A fabric woven or knitted from the commingled multifilament yarn made by the above-mentioned process exhibits an enhanced bulkiness by treating the fabric under relaxed conditions so that the difference in boiling water shrinkage between filaments A and B is produced and filament B highly shrinks to develop crimps. Where filament A has a self-elongating property, when the commingled multifilament yarn is heat-set at a high temperature, i.e., at least 160° C., the filament elongates and consequently the bulkiness of the fabric is more enhanced.

As mentioned above, it is preferable that the polyester filament of the invention is made into a multi-filament yarn, the yarn is woven or knitted into a fabric, and thereafter the fabric is subjected to an alkali treatment to separate the fins from the core. This is because the degree of separation of the fins from the core is higher in the surface portion of the fabric than in the central portion thereof. When the fabric is impregnated with an aqueous alkali solution, the solution penetrates first into the surface portion and then into the central portion, and therefore, the degree of fin separation in the surface portion is larger than that in the central portion. The bulkiness and nerve are manifested by the spreading action of the fins especially in the central part of fabric, and a soft touch and feeling are given on the surface thereof by the separated fins.

The alkali treatment should preferably be carried out to an extent such that the weight reduction is in the range of 10 to 40% by weight. If the weight reduction is smaller than 10% by weight, the separation of fins is insufficient and the fabric has a stiff touch. If the weight reduction is larger than 40% by weight, the separation of fins occurs to a great extent even in the central portion of the fabric and the separated fins are apt to be dissolved away with the result that the bulkiness and drape of the fabric are lost.

It is preferable that the degree (S) of separation of fins is at least 30%, and S of the filaments in the surface portions of the multifilament yarn is larger than S of the filaments in the central portion thereof. The degree (S) of separation of fins is defined by the following formula.

$$\text{Degree of separation } S\ (\%) = (\text{number of separated fins/total number of fins}) \times 100$$

The term "filaments in the surface portion of the multifilament yarn" used herein means ⅓ of the entire number of filaments, which are located in a circular portion inscribed on the hypothetical circumscribed circle of the cross-section of the multifilament yarn. The term "filaments in the central portion thereof" used herein means ⅓ of the entire number of filaments, which are located in the central portion of the hypothetical circumscribed circle of the cross-section of the multifilament yarn.

The invention will now be described by the following examples.

The physical properties of polyesters, polyester filaments and fabrics were evaluated by the following methods.

(1) Cross-sectional Shape and Dimensions of Filament

A photograph (3,000× magnification) of the cross-section of a filament is taken before the filament is treated with an alkali. The cross-sectional area (SA) and diameter (DA) of the core, and the cross-sectional area (SB), maximum length (LB) and maximum width (WB) of the fins are measured on the photograph.

(2) Spinnability

A polyester is melt-spun continuously over a period of 8 hours, and yarn breakage is observed. The following three ratings A, B and C are assigned.

Rating A: No single filament breakage occurred.

B: Single filament breakage occurred, i.e., fluff formation was observed.

C: Filament yarn breakage occurred.

(3) Degree of Separation of Fins S (%)

A photograph (1,000× magnification) of a filament is taken after the filament is treated with an alkali, and the number of fins separated from the core is counted. The degree (%) of separation of fins is calculated by the following formula.

$$\text{Degree of separation of fins } S\ (\%) = (\text{number of separated fins/total number of fins}) \times 100$$

(4) Touch and Feeling of Fabric

Touch, feeling, bulkiness, softness and draping property of a fabric are evaluated by an organoleptic examination. The evaluation results are expressed by five ratings A, B, C, D and E.

Rating A and rating E means that the touch and feeling are excellent and very poor, respectively.

(5) Compatibility Parameter

Solubilities in various solvents of a polyester and a compound in which microscopic phase separation can be observed between the compound and a polyester are measured, and solubility parameters δa and δb of the polyester and the compound are determined.

Compatibility parameter χ is calculated by the following formula.

$$\text{Compatibility parameter } \chi = (Va/RT)(\delta a - \delta b)^2$$

wherein Va is molar volume ($cm^3$/mol) of a polyester, R is gas constant (J/mol·K), T is absolute temperature (°K) δa and δb are solubility parameters ($J^{1/2}/cm^{3/2}$) of the polyester and the compound, respectively.

EXAMPLE 1

(Run 1 to 16)

A polyethylene terephthalate having an intrinsic viscosity of 0.64 and having incorporated therein 0.05% by weight of a titanium dioxide as a delustrant was melt-extruded at 275° C. through a spinneret having 24 sets of orifices, each set being illustrated in FIG. 2B (in Run 5 and Runs 8–16). While the core-forming molten filamentary extrudate was joined together with the four fin-forming molten filamentary extrudate, the extrudates were passed through a vertical spinning cylinder wherein the extrudates were cooled by blowing cooling air thereagainst in the direction perpendicular to the filamentary extrudates. The thus-solidified filamentary extrudates were taken-up at a take-up rate of 1,000 m/min.

The above-mentioned melt spinning procedure was repeated wherein dimensions (SA, DA) of the core-forming central orifice, the dimensions (SB, LB and WB) of the fin-forming slit-form orifices, number of the fin-forming slit-form orifices, and the rate of extrusion were varied. In the case of spinnerets having two fin-forming slit-form orifices (Run 2 and Run 3), two types of spinnerets were used, one of which had the two slit-form orifices arranged at an angle of 180°, i.e., in a straight line, with the center of the circular core-forming orifice, and the other of which had two slit-form orifices arranged at an angle of 90° with the center of the circular core-forming orifice. In the other spinnerets having 3 to 8 fin-forming slit-forming orifices (Runs 4–6 and Runs 8–16), the slit-form orifices were arranged at equal angles around the central circular core-forming orifice.

The filaments taken-up were heat-drawn at a drawing ratio of 2.55 by using a stretcher provided with hot rollers maintained at 90° C. and a slit heater maintained at 150° C. to obtain a multifilament yarn (54 deniers/24 filaments).

The filament yarn was knitted at a gauge of 20 to make a tubular knitted fabric, and then the knitted fabric was subjected to a weight-reduction treatment wherein the fabric was immersed in a boiling aqueous solution containing 40 g/l of sodium hydroxide for 20 minutes.

The cross-sectional shape and spinnability of the filaments are shown in Table 1.

The degree of separation of fins from the core as measured on the alkali-treated filaments, and touch and feeling of the alkali-treated tubular knitted fabric are shown in Table 2.

As seen from Tables 1 and 2, where the cross-sectional area (SA) and diameter (DA) of the core, and the cross-sectional area (SB), maximum length (LB) and maximum width (WB) of the fins satisfy the hereinbefore-mentioned requirements (1), (2) and (3) (Runs 1–7, 9–11 and 14–16), the degree of separation of fins was large and the touch and feeling were satisfactory. Where the number of fins was in the range of 3 to 6 (Runs 4–6, 9–11 and 14–16), the results were more satisfactory.

TABLE 1

| Run No. | Number of fins | SB/SA | LB/DA | WB/DA | Spinnability |
|---|---|---|---|---|---|
| 1 | 1 | 1/4 | 1.0 | 1/5 | A |
| 2 | 2 *1 | 1/4 | 1.1 | 1/5 | A |
| 3 | 2 *2 | 1/4 | 1.0 | 1/5 | A |
| 4 | 3 | 1/4 | 0.9 | 1/5 | A |
| 5 | 4 | 1/4 | 0.9 | 1/5 | A |
| 6 | 6 | 1/4 | 0.8 | 1/5 | A |
| 7 | 8 | 1/4 | 0.8 | 1/5 | A |
| 8* | 4 | 1/6 | 0.5 | 1/5 | A |
| 9 | 4 | 1/5 | 0.7 | 1/5 | A |
| 10 | 4 | 1/5 | 1.5 | 1/5 | A |
| 11 | 4 | 1/3 | 2.5 | 1/5 | A |
| 12* | 4 | 1/2 | 3.5 | 1/5 | C |
| 13* | 4 | 1/2 | 0.9 | 1/3 | A |
| 14 | 4 | 1/3 | 0.9 | 1/4 | A |
| 15 | 4 | 1/5 | 0.9 | 1/6 | A |
| 16 | 4 | 1/6 | 0.9 | 1/8 | A |

*Comparative Examples

*1 Arranged at an angle of 180°

*2 Arranged at an angle of 90°

TABLE 2

| Run No. | Weight reduction (%) | Degree of separation of fins (%) Surface | Degree of separation of fins (%) Center | Feeling and touch of fabric |
|---|---|---|---|---|
| 1 | 20 | 70 | 67 | C |
| 2 | 18 | 70 | 64 | C |
| 3 | 19 | 66 | 64 | C |
| 4 | 21 | 63 | 51 | B |
| 5 | 20 | 61 | 43 | B |
| 6 | 17 | 53 | 38 | C |
| 7 | 14 | 35 | 30 | C |
| 8* | 16 | 48 | 40 | E |
| 9 | 18 | 58 | 45 | C |
| 10 | 22 | 62 | 48 | B |
| 11 | 24 | 56 | 43 | B |
| 12* | 27 | 41 | 30 | D |
| 13* | 18 | 30 | 20 | E |
| 14 | 20 | 51 | 37 | C |
| 15 | 21 | 65 | 43 | B |
| 16 | 23 | 71 | 53 | C |

EXAMPLE 2

(Run 17 to Run 29)

The procedure employed in Example 5 was repeated wherein a compound in which microscopic phase separation is capable of occurring between the polyester and the compound was incorporated in the polyester. All other conditions remained the same.

The kind of the compound, the value of $\chi$, the amount thereof and the spinnability of filament are shown in Table 3. In Table 3, abbreviations PEG, PE and PMMA means polyethylene glycol, polyethylene and polymethyl methacrylate, respectively. Copolymerization ratio (asterisked) is by mole.

The degree of separation of fins from the core as evaluated after the alkali treatment, and the touch and feeling of the tubular knitted fabric are shown in Table 4.

TABLE 3

| Run No. | | $\chi$ | Amount | Spinnability |
|---|---|---|---|---|
| 17 | PEG | 0.08 | 3.0 | A |
| 18 | $C_5H_{11}$-grafted PEG | 0.1 | 3.0 | A |
| 19 | $C_{15}H_{31}$-grafted PEG | 0.25 | 3.0 | A |
| 20 | PE(30)-PMMA(70) copolymer* | 0.33 | 3.0 | A |
| 21 | PE(75)-PMMA(25) copolymer* | 0.51 | 3.0 | A |
| 22 | PE(90)-PMMA(10) copolymer* | 1.3 | 3.0 | A |
| 23 | PE(95)-PMMA(5) copolymer* | 1.7 | 3.0 | A |
| 24 | PE | 2.2 | 3.0 | C |
| 25 | PMMA | 2.3 | 3.0 | B |
| 26 | $C_{15}H_{31}$-grafted PEG | 0.25 | 0.3 | A |
| 27 | $C_{15}H_{31}$-grafted PEG | 0.25 | 0.7 | A |
| 28 | $C_{15}H_{31}$-grafted PEG | 0.25 | 4.0 | A |
| 29 | $C_{15}H_{31}$-grafted PEG | 0.25 | 6.0 | B |

TABLE 4

| Run No. | Weight reduction (%) | Degree of separation of fins (%) Surface | Center | Feeling and touch of fabric |
|---|---|---|---|---|
| 17 | 20 | 62 | 44 | B |
| 18 | 20 | 66 | 47 | A |
| 19 | 20 | 72 | 51 | A |
| 20 | 20 | 78 | 59 | A |
| 21 | 20 | 83 | 64 | A |
| 22 | 20 | 89 | 68 | A |
| 23 | 20 | 95 | 74 | A |
| 24 | 20 | 70 | 52 | B |
| 25 | 20 | 71 | 54 | B |
| 26 | 20 | 63 | 41 | B |
| 27 | 20 | 74 | 53 | A |
| 28 | 20 | 79 | 60 | A |
| 29 | 20 | 74 | 56 | B |

EXAMPLE 3

(Run 30 to Run 32)

In Run 30, a polyester was melt-spun through a spinneret having 18 slit-form orifices (L/D=5) and taken-up at a rate of 1,500 m/min to obtain filaments. The thus-obtained filaments were drawn at a pre-heating temperature of 90° C. and at a drawing ratio of 2.7 to obtain a polyester multifilament yarn (B) (36 denier/18 filaments).

The polyester multi-lobal multifilament yarn (A) obtained in Example 5 and the above-mentioned polyester multifilament yarn (B) are combined together and entangled by blowing thereagainst compressed air having a pressure of 1.5 kg/cm$^2$ by an interlacing nozzle at a over feed ratio of 1.5% to obtain a commingled multifilament yarn.

An S twist yarn was made by twisting the union multifilament yarn at 300 twists/meter, and HABUTAE fabric was made by using the multifilament yarn as both weft and warp. The fabric was subjected to a heat relaxation treatment and then heat-set, and thereafter an alkali treatment was carried out by the same procedure as in Example 5 whereby 20% by weight of the fabric was reduced.

In Run 31, the above procedure in Run 30 was repeated wherein the thickness of the multi-lobal filament yarn A was changed to 24 deniers/18 filaments and the thickness of the filament yarn B was changed to 100 deniers/24 filaments with all other conditions remaining the same.

In Run 32, the above procedure in Run 30 was repeated wherein the multi-lobal filament yarn A and the filament yarn B were substituted by a multi-lobal filament yarn A and a multifilament yarn B which were made as follows, respectively. All other conditions remained substantially the same.

The multi-lobal filament yarn A was made as follows. A polyethylene terephthalate having an intrinsic viscosity of 0.64 and having incorporated therein 0.05% by weight of a titanium dioxide as a delustrant was melt-extruded at 275° C. through a spinneret having 24 sets of orifices, each set having a core-forming central orifice and four fin-forming slit-form orifices as illustrated in FIG. 2B. While the core-forming molten filamentary extrudate was joined together with the four fin-forming molten filamentary extrudates, the extrudates were passed through a vertical spinning cylinder wherein the extrudates were cooled by blowing cooling air thereagainst in the direction perpendicular to the filamentary extrudates. The thus-solidified filamentary extrudates were taken-up at a take-up rate of 2,500 m/min. The thus-obtained filaments were drawn at a pre-heating temperature of 90° C. and at a drawing ratio of 1.8, and then, were subjected to a heat relaxation treatment by using a non-contact type heater maintained at 150° C. at a over feed ratio of 2% to obtain a polyester multifilament yarn (A) (54 denier/24 filaments).

The multifilament yarn B was made as follows. A polyester was melt-spun through a spinneret having 18 round-form orifices and taken-up at a rate of 1,500 m/min to obtain filaments. The thus-obtained filaments were drawn at a pre-heating temperature of 90° C. and at a drawing ratio of 3.0 to obtain a polyester multifilament yarn (B) (36 deniers/18 filaments).

By the same procedure as that in Run 30, the multi-lobal filament yarn A and the filament yarn B were combined together to obtain a union multifilament yarn, and a HABUTAE fabric was woven therefrom and subjected to an alkali treatment.

In Run 30 to Run 32, the boiling water shrinkage and dry heat shrinkage of the multifilament yarn A, the boiling water shrinkage of the multifilament yarn B, and the union ratio of the filament yarn A to the sum of filament yarns A plus B are shown in Table 5. The degree of separation of fins from the core in the filament yarn A and the touch and feeling of the fabric are shown in Table 6.

TABLE 5

| Run No. | Multifilament (A) Boiling water shrinkage (%) | Dry heat shrinkage (%) | Commingling A/(A + B) (%) | Multi-filament (B) Boiling water shrinkage (%) |
|---|---|---|---|---|
| 30 | 8 | 0.5 | 60 | 16 |
| 31 | 6 | 0.3 | 20 | 18 |
| 32 | 6 | −5 | 54 | 16 |

TABLE 6

| Run No. | Degree of separation of fins (%) Surface | Center | Feeling and touch of fabric |
|---|---|---|---|
| 30 | 53 | 38 | B |
| 31 | 47 | 31 | D |
| 32 | 52 | 37 | A |

EXAMPLE 4

(Run 33 to Run 37)

The procedure employed in Run 5 was repeated wherein the conditions for the alkali treatment were changed and thus the weight reduction (%) of the fabric was changed as shown in Table 7. All other conditions remained the same.

The degree of separation of fins from the core in the filament, and the touch and feeling of the fabric are shown in Table 7.

TABLE 7

| Run No. | Weight reduction (%) | Degree of separation of fins (%) Surface | Center | Feeling and touch of fabric |
|---|---|---|---|---|
| 33 | 6 | 28 | 15 | D |
| 34 | 11 | 42 | 30 | C |
| 35 | 20 | 60 | 42 | B |
| 36 | 38 | 73 | 64 | B |
| 37 | 50 | 88 | 88 | D |

Industrial Applicability

The polyester multifilament yarn of the present invention is characterized in that the fins of each filament are separated from the core thereof and voluminous vacant spaces are formed inside the yarn, and therefore, the yarn is bulky. A woven or knitted fabric composed of the multifilament yarn is bulky and has soft to touch and a uniform appearance.

More specifically, multilobal cross-section filaments having a core and a plurality of fins radially extending from the core have a function of spreading the vacant spaces among the filaments because the radially extending fins are spread out. When the fins are separated from the core by a weight-reducing alkali treatment, the voluminous vacant spaces formed by the spread fins remain as they are. The degree of fin separation is more prominent in the surface portion of the filament yarn than in the central portion thereof, and further, the separated fins are slender and thin, namely, have a rectangular cross-section having a length larger and a width narrower than the diameter of the core. Therefore, a fabric of the multifilament yarn exhibits soft touch and feeling and good draping property. The fabric has voluminous vacant spaces formed by the spread fins in the central portion of the yarn, and thus, the fabric has good bulkiness, nerve and drape.

In the multifilament yarn before the weight-reducing alkali treatment, the fins and the core have different degrees of orientation, and the bonding force between the fins and the core is low. Thus, by the alkali treatment, the fins can easily be separated from the core while the formation of free protruding fiber ends is minimized. The resulting fabric has a uniform appearance.

In view of the above-mentioned beneficial properties, the polyester multifilament yarn of the present invention is especially useful for articles of clothing.

We claim:

1. A polyester filament yarn which is made by treating a polyester filament with an aqueous alkali solution, said polyester filament being composed of a core extending over the length of filament and a plurality of fins bonded to the core over the length of the core and radially extending from the core, and said polyester filament satisfying the following requirements (1), (2) and (3):

(1) $1/20 \leqq SB/SA \leqq 1/3$ (2) $0.6 \leqq LB/DA \leqq 3.0$ (3) $WB/DA \leqq 1/4$ wherein SA represents a cross-sectional area of the core, DA represents a diameter of the core when the cross-sectional shape of the core is true circle, or a diameter of the circumscribed circle of the core when the cross-sectional shape of the core is not true circle, and SB, LB and WB represent cross-sectional area, maximum length and maximum width of the fins, respectively; said fins being at least partially separated from the core by the treatment with the aqueous alkali solution.

2. The polyester filament yarn according to claim 1, wherein 3 to 6 fins are bonded to the core in the polyester filament to be treated with an aqueous alkali solution.

3. The polyester filament yarn according to claim 1, wherein at least 30% of the total number of fins are separated from the core in the polyester filament yarn.

4. The polyester filament yarn according to claim 1, wherein the core has a thickness of 1 to 4 deniers and each of the fins has a thickness of not larger than 0.8 denier.

5. The polyester filament yarn according to claim 1, wherein the polyester constituting the filament yarn comprises a polyester having incorporated therein 0.5 to 5.0% by weight of a compound having a compatibility parameter $\chi$ of 0.1 to 2.0, which parameter is defined by the following equation:

$$\text{Compatibility parameter } \chi=(Va/RT)(\delta a-\delta b)^2$$

wherein Va is molar volume ($cm^3$/mol) of the polyester, R is gas constant (J/mol·K), T is absolute temperature (°K), and $\delta a$ and $\delta b$ represent solubility parameters ($J^{1/2}/cm^{3/2}$) of the polyester and the compound, respectively.

6. The polyester filament yarn according to claim 1, wherein said compound has a molecular weight of 3,000 to 25,000.

7. A process for producing a polyester filament yarn which comprises:

extruding a molten polyester through a spinneret having a central orifice for forming a core and a plurality of slit-form orifices for forming fins which are arranged at intervals around the core-forming orifice in a configuration of radially extending from the core-forming orifice so that a molten polyester extrudate from the core-forming orifice is contacted with molten polyester extrudates from the fin-forming orifices;

cooling the contacted molten polyester extrudates whereby a solidified filament is formed which is composed of a core extending over the length of filament and a plurality of fins bonded to the core over the length of the core and radially extending from the core, and which satisfies the following requirements (1), (2) and (3):

(1) $1/20 \leqq SB/SA \leqq 1/3$ (2) $0.6 \leqq LB/DA \leqq 3.0$ (3) $WB/DA \leqq 1/4$ wherein SA represents a cross-sectional area of the core, DA represents a diameter of the core when the cross-sectional shape of the core is true circle, or a diameter of the circumscribed circle of the core when the cross-sectional shape of the core is not true circle, and SB, LB and WB represent cross-sectional area, maximum length and maximum width of the fins, respectively; and thereafter treating the filament with an aqueous alkali solution to reduce the weight of the filament and at least partially separate the fins from the core.

8. The process for producing a polyester filament yarn according to claim 7, wherein, prior to the extruding the molten polyester through the spinneret, 0.5 to 5.0% by weight, based on the polyester, of a compound having a compatibility parameter $\chi$ of 0.1 to 2.0 is incorporated in the polyester, which parameter $\chi$ is defined by the following equation:

Compatibility parameter $\chi=(Va/RT)(\delta a-\delta b)^2$ wherein Va is molar volume ($cm^3$/mol) of the polyester, R is gas constant (J/mol·K), T is absolute temperature (°K), and $\delta a$ and $\delta b$ represent solubility parameters ($J^{1/2}/cm^{3/2}$) of the polyester and the compound, respectively.

9. The process for producing a polyester filament yarn according to claim 7, wherein the spinneret has at least one set of orifices comprising one core-forming orifice and 3 to 6 fin-forming slit-form orifices.

10. The process for producing a polyester filament yarn according to claim 7, wherein the spinneret satisfies the following three requirements (i), (ii) and (iii):

(i) $1 \leqq L'B/D'A \leqq 4$ (ii) $1/7 \leqq W'B/D'A \leqq 1/2$ (iii) $0.01\ mm \leqq L'AB \leqq 0.2\ mm$ wherein D'A represents a diameter of the core-forming circular orifice when the orifice shape is true circle, or a diameter of the circumscribed circle of the core-forming circular orifice when the orifice shape is not true circle; L'B and W'B represent maximum length and maximum width of the fin-forming slit-form orifices, respectively; and L'AB represents the shortest distance between the core-forming orifice and the fin-forming orifices.

11. The process for producing a polyester filament yarn according to claim 7, wherein the treatment of the filament with an aqueous alkali solution is carried out by placing the filament in contact with an aqueous alkali solution having a concentration of 10 to 100 g/l at a temperature of 40° to 180° C. to an extent such that 10 to 40% of the weight of filament is reduced.

* * * * *